US005341456A

United States Patent [19]

DeJaco

[11] Patent Number: 5,341,456

[45] Date of Patent: Aug. 23, 1994

[54] METHOD FOR DETERMINING SPEECH ENCODING RATE IN A VARIABLE RATE VOCODER

[75] Inventor: Andrew P. DeJaco, San Diego, Calif.

[73] Assignee: QUALCOMM Incorporated, San Diego, Calif.

[21] Appl. No.: 984,602

[22] Filed: Dec. 2, 1992

[51] Int. Cl.[5] ..... G10L 9/00

[52] U.S. Cl. ..... 395/2.23; 395/2.28; 395/2.38

[58] Field of Search ..... 395/2, 2.23, 2.28, 2.38, 395/2.42, 2.24, 2.17; 381/29–45

[56] References Cited

U.S. PATENT DOCUMENTS 4,890,327 12/1989 Betrand et al. ..... 381/38
4,899,384 2/1990 Crouse et al. ..... 381/31
5,222,189 6/1993 Fielder ..... 381/31

*Primary Examiner*—Allen R. MacDonald
*Assistant Examiner*—Michelle Doerrler
*Attorney, Agent, or Firm*—Russell B. Miller; Sean English

[57] ABSTRACT

In a variable rate vocoder a method for determining a higher encoding rate of a set of encoding rates for unvoiced speech. The method is accomplished by generating an encoding rate indication based upon a first characteristic of an audio signal, determining a second characteristic of the audio signal, and modifying the encoding rate indication when the second characteristic of the audio signal is representative of unvoiced speech to provide a modified encoding rate indication corresponding to a higher encoding rate of the set of encoding rates.

12 Claims, 6 Drawing Sheets

THRESHOLD COMPUTATION
102
C
100
FRAME ENERGY $E_f$
B
R
116
MUX
114
132
130
128
MUX
122
126
118
1
120
K
124
$RT_p$
RATE RAMP DOWN LOGIC
104
$RT_i$
FULL RATE OVERRIDE LOGIC
108
$k_0$
$RT_i'$
HANGOVER LOGIC
110
RATE LIMITER LOGIC
112
FINAL RATE DECISION $RT_f$
INPUT FROM μP
R
106

METHOD FOR DETERMINING SPEECH ENCODING RATE IN A VARIABLE RATE VOCODER

BACKGROUND OF THE INVENTION

I. Field of the Invention

The present invention relates to vocoders. More particularly, the present invention relates to a novel and improved method for determining speech encoding rate in a variable rate vocoder.

II. Description of the Related Art

Variable rate speech compression systems typically use some form of rate determination algorithm before encoding begins. The rate determination algorithm assigns a higher bit rate encoding scheme to segments of the audio signal in which speech is present and a lower rate encoding scheme for silent segments. In this way a lower average bit rate will be achieved while the voice quality of the reconstructed speech will remain high. Thus to operate efficiently a variable rate speech coder requires a robust rate determination algorithm that can distinguish speech from silence in a variety of background noise environments.

One such variable rate speech compression system or variable rate vocoder is disclosed in copending U.S. patent application Ser. No. 07/713,661 filed Jun. 11, 1991, entitled "Variable Rate Vocoder" and assigned to the assignee of the present invention, the disclosure of which is incorporated by reference. In this particular implementation of a variable rate vocoder, input speech is encoded using Code Excited Linear Predictive Coding (CELP) techniques at one of several rates as determined by the level of speech activity. The level of speech activity is determined from the energy in the input audio samples which may contain background noise in addition to voiced speech. In order for the vocoder to provide high quality voice encoding varying levels of background noise which may affect the speech activity level detection and rate determination, an adaptively adjusting threshold technique is used to compensate for the affect of background noise on rate decision.

Vocoders are typically used in communication devices such as cellular telephones or personal communication devices to provide digital signal compression of an analog audio signal that is converted to digital form for transmission. In a mobile environment in which a cellular telephone or personal communication device may be used, high levels of background noise energy make it difficult for the rate determination algorithm to distinguish low energy unvoiced sounds from background noise silence using a signal energy based rate determination algorithm. Thus unvoiced sounds frequently get encoded at lower bit rates and the voice quality becomes degraded as consonants such as "s", "x", "ch", "sh", "t", etc. are lost in the reconstructed speech.

It is therefore an object of the present invention to provide in a variable rate vocoder an improvement in rate determination for unvoiced speech.

It is yet another object of the present invention to provide a technique for distinguishing low energy unvoiced speech from background noise in a variable rate vocoder in which rate determination is based upon signal energy to provide improved quality in the vocoded speech.

SUMMARY OF THE INVENTION

The present invention is a novel and improved method for distinguishing low energy unvoiced speech from background noise in a variable rate vocoder in which rate determination is based upon signal energy.

In the mobile environment road noise is the most probable noise and is typically characterized by a lowpass spectrum with a spectral slope or tilt of −10 to −20 dB per octave. Office noise is also lowpass in nature and in contrast typically has a spectral tilt of −8 to −12 dB per octave. In other words, the energy of the noise signal decreases as frequency increases thus giving noise a distinct spectral slope. In contrast, the unvoiced sounds described above are spectrally broadband in nature and may be characterized as having a somewhat constant slope in signal energy over frequency. Thus a simple scheme for measuring the spectral tilt of the input speech can distinguish broadband unvoiced sounds from narrowband background noise. The energy based rate determination algorithm can therefore be considerably enhanced by allowing this spectral tilt feature to be incorporated into the overall rate determination scheme.

The full rate override algorithm, based upon the spectral tilt feature described above, is particularly useful because it is of low computational complexity. The spectral tilt of the input speech can be easily acquired from the preprocessing of the input speech for all Linear Prediction Coding (LPC) based vocoders such as CELP vocoders, thus no extra spectral computation is required. The first reflection coefficient ($k_0$) computed during LPC analysis is linearly related to the spectral tilt of the input speech.

The full rate override algorithm as implemented herein also provides an extreme robustness against false unvoiced detections. False unvoiced detections would increase the average data rate without incurring any gain in voice quality. The algorithm is more robust to falsely detecting unvoiced speech in background noise because it uses a less variant global spectral parameter (spectral tilt) in which to base a decision, versus a higher dimensional spectral description e.g., 10th order LPC model, Discrete Fourier Transform (DFT), etc., which would tend to show more variance across background noise frames and thus have a greater probability of false detection. False detections are also minimized as the algorithm continually updates the estimate of the average spectral tilt of the background noise to insure it maintains a lowpass tilt with a decay per octave above an appropriate threshold. Also, if the percentage of unvoiced frames distinguished by the algorithm becomes too large (unvoiced sections of speech are typically no more than 500 msec. in duration), the unvoiced detection scheme will be disabled until a new background noise spectral estimate can be computed which meets the spectral tilt characteristics of road noise.

In accordance with the present invention a method is provided for use in a variable rate vocoder for determining a higher encoding rate from a set of encoding rates for unvoiced speech which might otherwise be encoded at a lower rate resulting in reduced speech quality. The method is accomplished by generating an encoding rate indication based upon a first characteristic of an audio signal, determining a second characteristic of the audio signal, and modifying the encoding rate indication when the second characteristic of the audio signal is representative of unvoiced speech to provide a modified encoding rate indication corresponding to a higher encoding rate of the set of encoding rates.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Figure 1:
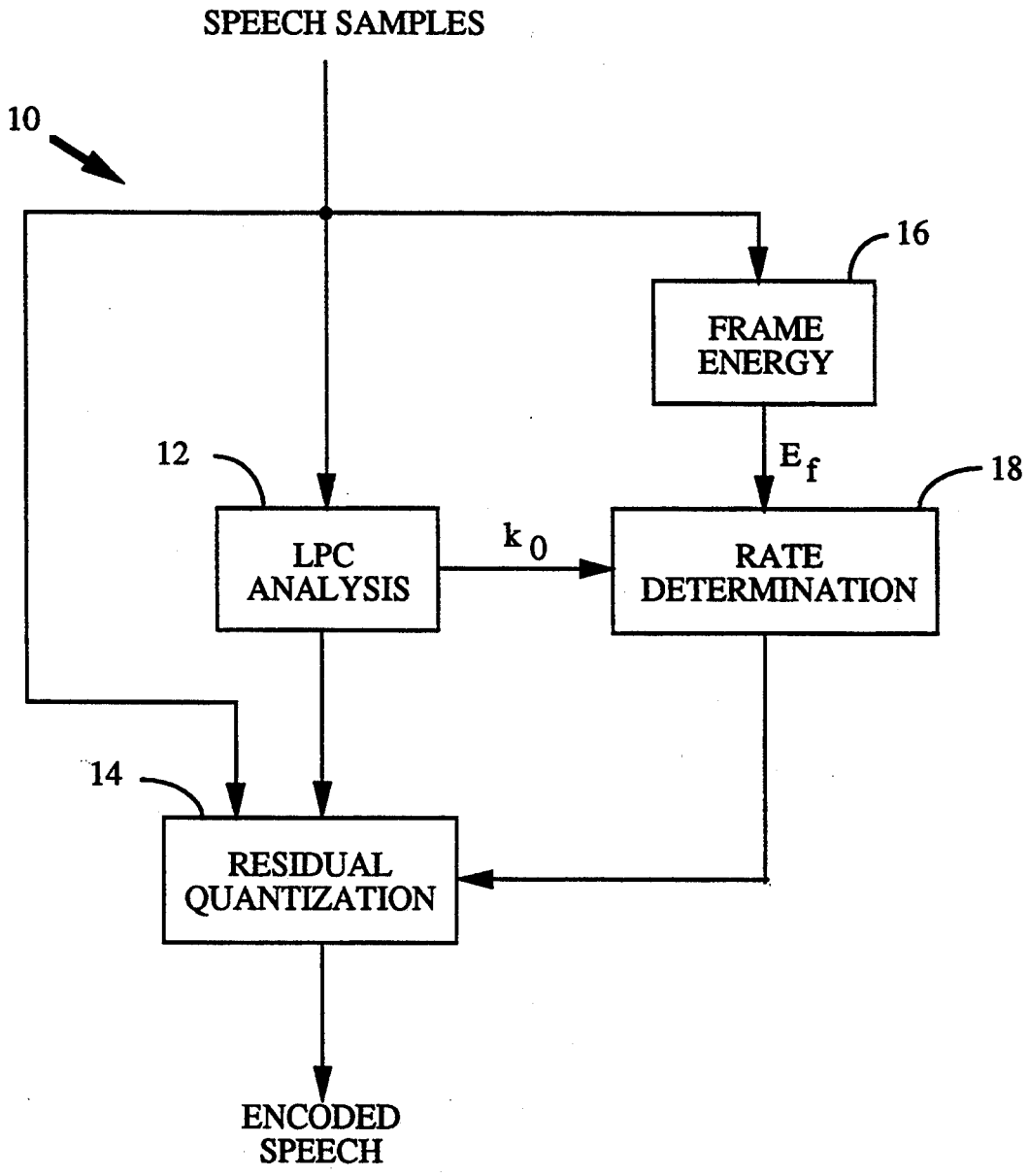
FIG. 1 is a general functional block diagram of the encoder portion of a variable rate vocoder.

In accordance with the present invention, sounds such as speech and/or background noise are sampled and digitized using well known techniques. For example the analog signal may be converted to a digital format by the standard 8 bit/μlaw format followed by a μlaw/uniform code conversion. In the alternative, the analog signal may be directly converted to digital form in a uniform pulse code modulation (PCM) format. Each sample in the preferred embodiment is thus represented by one 16 bit word of data. The samples are organized into frames of input data wherein each frame is comprised of a predetermined number of samples. In the exemplary embodiment disclosed herein an 8 kHz sampling rate is considered. Each frame is comprised of 160 samples or of 20 msec. of speech at the 8 kHz sampling rate. It should be understood that other sampling rates and frame sizes may be used.

The field of vocoding includes many different techniques for speech coding, one of which is the CELP coding technique. An summary of the CELP coding technique is described in the previously mentioned paper "A 4.8 kbps Code Excited Linear Predictive Coder". The present invention implements a form of the CELP coding techniques so as to provide a variable rate in coded speech data wherein the LPC analysis is performed upon a constant number of samples, and the pitch and codebook searches are performed on varying numbers of samples depending upon the transmission rate. In concept the CELP coding techniques as applied to the present invention are discussed with reference to FIGS. 1 and 3.

In the preferred embodiment of the present invention, the speech analysis frames are 20 msec. in length, implying that the extracted parameters are transmitted in a burst 50 times per second. Furthermore the rate of data transmission is varied from roughly 8 kbps to 4 kbps to 2 kbps, and to 1 kbps. At full rate (also referred to as rate 1), data transmission is at an 8.55 kbps rate with the parameters encoded for each frame using 171 bits including an 11 bit internal CRC (Cyclic Redundancy Check). Absent the CRC bits the rate would be 8 kbps. At half rate (also referred to as rate $\frac{1}{2}$), data transmission is at a 4 kbps rate with the parameters encoded for each frame using 80 bits. At quarter rate (also referred to as rate $\frac{1}{4}$), data transmission is at a 2 kbps rate with the parameters encoded for each frame using 40 bits. At eighth rate (also referred to as rate $\frac{1}{8}$), data transmission is slightly less than a 1 kbps rate with the parameters encoded for each frame using 16 bits. In an exemplary communication system transmission scheme additional overhead bits are added to each frame such that the full, half, quarter and eighth rate frames are respectively transmitted at data rates of 9.6 kbps, 4.8 kbps, 2.4 kbps and 1.2 kbps.

Referring now to FIG. 1, variable rate vocoder 10 in an exemplary embodiment uses speech compression techniques based on linear predictive coding (LPC). Vocoder 10 is comprised of LPC analysis element 12, residual quantization element 14, frame energy computation element 16 and rate determination element 18. Element 12 receives the frame of PCM speech samples and performs an LPC analysis thereupon. Frame energy computation element 16 also receives the frame of PCM speech samples and computes therefrom a frame energy value $E_f$. It should be noted that the LPC analysis performed in element 12 is independent of the frame encoding rate determined by rate determination element 18. The LPC analysis computes the LPC spectral parameters and as a by product of the analysis computes a set of reflection coefficients $k_i$. The first reflection coefficient $k_0$ is used as a measurement of the spectral tilt of the speech in the full rate override aspect implemented within rate determination element 18.

The frame energy value is provided to element 18 where used to determine the frame rate. As mentioned previously the first reflection coefficient $k_0$ is within element 18 to modify an initially determined rate based upon frame energy. If the initial rate decision based upon frame energy indicates that full rate encoding is not required, a full rate override algorithm is used to determine if the input speech is unvoiced. If the full rate override algorithm decides the input frame is unvoiced it overrides the rate decision block and calls for full rate encoding of the input frame. After the full rate override block, the rate decision is complete and encoding proceeds for the determined rate in residual quantization element 14.

Once the frame rate and LPC spectral parameters are computed they are provided to residual quantization element 14. In element 14 the speech is further processed to produce a frame of vocoded speech. Further details on element 14 are provided in the above mentioned patent application and are incidental to the present invention.

In element 16 frame energy $E_f$ is computed from the PCM samples in the frame according to the following equation:

$$E_f = \sum_{n=0}^{L_A-1} |s(n+60)|^2; \quad (1)$$

where s(n) is the frame speech sample; and $L_A$ is the sample frame size.

It should be noted that the frame energy is computed from the samples used for the LPC analysis, wherein in the exemplary embodiment this set of samples is offset from the frame of samples used for residual quantization as discussed later.

Figure 2:
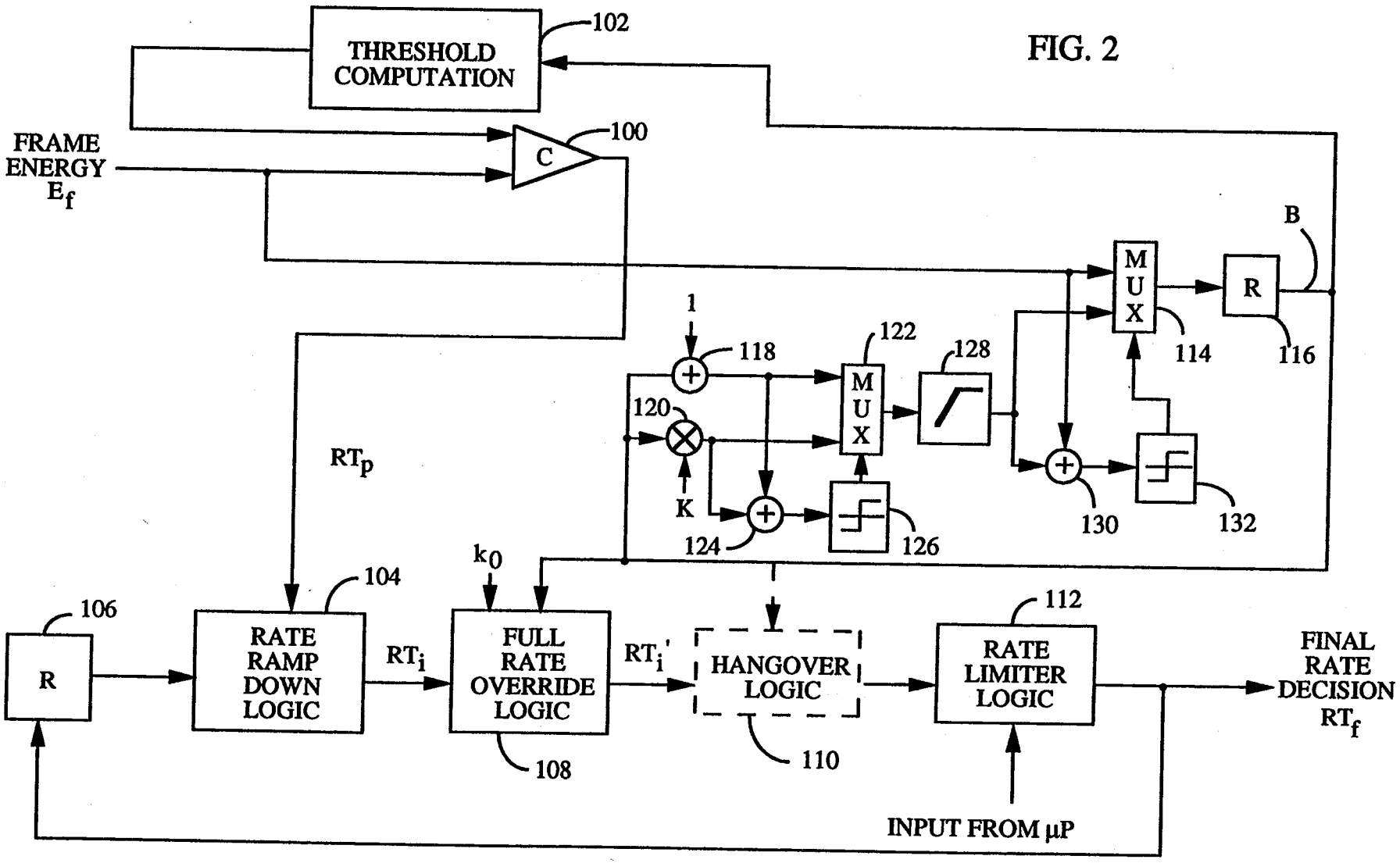
FIG. 2 is a block diagram of the rate determination element of FIG. 1.

The computed frame energy $E_f$ is provided to rate determination element 18 which is shown in further detail in FIG. 2. Rate determination 18 has two functions: (1) to determine the rate of the current frame, and (2) to compute a new estimate of the background noise level. The rate for the current frame is initially determined based on the current frame's energy, the previous estimate of the background noise level, the previous rate, the spectral content of the reflection coefficient $k_0$ and the rate command from a controlling microprocessor. The new background noise level is estimated using the previous estimate of the background noise level and the current frame energy.

An adaptive thresholding technique is preferably used for rate determination. As the background noise changes so do the thresholds which are used in selecting the rate. In the exemplary embodiment, three thresholds are computed to determine a preliminary rate selection $RT_p$. Exemplary thresholds are functions of the previous background noise estimate B, and are shown below.

For a background noise estimate of $B<25358$ (or 22 dB) the three thresholds are computed as a function of B as follows:

$$T1(B)=5.011872\ B; \quad (2)$$

$$T2(B)=-(3.374524\ (10^{-6}))\ B^2 + 8.016335\ B + 317.47; \quad (3)$$

and $$T3(B)=-(7.611724\ (10^{-6}))\ B^2 + 12.76279\ B + 493.97. \quad (4).$$

For a background noise estimate of $B>25,358$ (or 22 dB) the three thresholds are computed as a function of B as follows:

$$T1(B)=5.011872\ B; \quad (5)$$

$$T2(B)=1.712251\ (10^{-8})\ B^2 + 6.214276\ B + 43,834; \quad (6)$$

and $$T3(B)=3.853508\ (10^{-8}))\ B^2 + 8.698038\ B + 98,650 \quad (7).$$

The frame energy is compared to the three computed thresholds T1(B), T2(B) and T3(B). If the frame energy is below all three thresholds, the lowest rate of transmission (1 kbps), rate $\frac{1}{8}$ where $RT_p=4$, is selected. If the frame energy is below two thresholds, the second rate of transmission (2 kbps), rate $\frac{1}{4}$ where $RT_p=3$, is selected. If the frame energy is below only one threshold, the third rate of transmission (4 kbps), rate $\frac{1}{2}$ where $RT_p=2$, is selected. If the frame energy is above all of the thresholds, the highest rate of transmission (8 kbps), rate 1 where $RT_p=1$, is selected.

The preliminary rate $RT_p$ may then be modified based on the previous frame final rate $RT_r$. If the preliminary rate $RT_p$ is less than the previous frame final rate minus one ($RT_r-1$), an intermediate rate $RT_i$ is set where $RT_i=(RT_r-1)$. This modification process causes the rate to slowly ramp down when a transition from a high energy signal to a low energy signal occurs. However should the initial rate selection be equal to or greater than the previous rate minus one ($RT_r-1$), the intermediate rate $RT_i$ is set to the same as the preliminary rate $RT_p$, i.e. $RT_i=RT_p$. In this situation the rate thus immediately increases when a transition from a low energy signal to a high energy signal occurs.

Furthermore the full rate override aspect of the present invention is used to modify the intermediate rate $RT_i$ should the preliminary rate $RT_p$ be less than full rate. Based upon the spectral tilt of the speech frame as indicated by the reflection coefficient $k_0$ and the background noise estimate B the intermediate rate $RT_i$ may be set to a full rate indication.

As an option a hangover for the full rate determination may be provided. In this option regardless of the way in which the intermediate rate $RT_i$ is set to a full rate indication the intermediate rate $RT_i$ is set to full rate for the next several frames.

Finally, the intermediate rate $RT_i$ is further modified by rate bound commands from a microprocessor. If the rate $RT_i$ is greater than the highest rate allowed by the microprocessor, the final rate $RT_f$ is set to the highest allowable value. Similarly, if the intermediate rate $RT_i$ is less than the lowest rate allowed by the microprocessor, the final rate $RT_f$ is set to the lowest allowable value.

In certain cases it may be desirable to code all speech at a rate determined by the microprocessor. The rate bound commands can be used to set the frame rate at the desired rate by setting the maximum and minimum allowable rates to the desired rate.

FIG. 2 illustrates in block diagram form an exemplary implementation of the rate determination features of the present invention. In FIG. 2 the frame energy value $E_f$ is provided to as an input to a comparator 100 where it is compared with the thresholds T1(B), T2(B) and T3(B) computed in threshold computation element 102. The preliminary rate estimate $RT_p$ generated by comparator 102 is provided to rate ramp down logic 104. Also provided to logic 104 is the previous frame final rate $RT_f$ that is stored in register 106. Logic 104 computes the value ($RT_r-1$) and provides as an output the larger of the preliminary rate estimate $RT_p$ and the value $(RT_r-1)$ as the intermediate rate estimate value $RT_i$ to full rate override element 108. Further details on the modification of the value $RT_i$ to full rate override logic 108 are discussed with reference to FIGS. 4 and 5 herein. The output intermediate rate estimate value $RT_i'$ from full rate override logic 108 is provided to optional hangover logic 110.

Hangover logic 110 detects a full rate indication of the intermediate rate $RT_i'$ and sets the intermediate rate $RT_i'$ to a full rate indication for several frames following the initially detected full rate frame indication. Although hangover logic 110 may function independent of other elements, it may operate under the control of full rate override logic 108 to provide the hangover function in the event of a modification of the intermediate rate $RT_i$ by full rate override logic 108.

During higher than normal background noise conditions it has been found that the rate determination algorithm performs better if a modest full rate hangover is used. The hangover used is a function of the background noise as such:

| | | |
|---|---|---|
| FRAME HANGOVER (N) | = 0 frames if B < 11 dB; | |
| | = 1 frames if 11 dB <= B < 16 dB; | |
| | = 2 frames if 16 dB <= B < 21 dB; | |
| | = 3 frames if 21 dB <= B < 26 dB; | |
| | or | |
| | = 4 frames if 26 dB <= B | (8) |

The full rate hangover means that between the last full rate frame declared by the rate determination algorithm and the next declared non-full rate frame there must be N full rate frames, where N is the number of hangover frames.

The output of full rate override logic 108, or hangover logic 110 if provided, is provided to rate limiter logic 112. As mentioned previously, the microprocessor provides rate bound commands to the vocoder, particularly to logic 112. Logic 112 ensures that the rate does not exceed the rate bounds and modifies the value $RT_i$ should it exceed the bounds. Should the value $RT_i$ be within the range of allowable rates it is output from logic 112 as the final rate value $RT_f$. The final rate value $RT_f$ is output from logic 112 to residual quantization element 14 of FIG. 1.

The background noise estimate as mentioned previously is used in computing the adaptive rate thresholds. For the current frame the previous frame background noise estimate B is used in establishing the rate thresholds for the current frame. However for each frame the background noise estimate is updated for use in determining the rate thresholds for the next frame. The new background noise estimate B' is determined in the current frame based on the previous frame background noise estimate B and the current frame energy $E_f$.

In determining the new background noise estimate B for use during the next frame (as the previous frame background noise estimate B) two values are computed. The first value $V_1$ is simply the current frame energy $E_f$. The second value $V_2$ is the larger of B+1 and KB, where K=1.00547. To prevent the second value from growing too large, it is forced to be below a large constant M=5,059,644 (which is the equivalent of 45 dB). The smaller of the two values $V_1$ or $V_2$ is chosen as the new background noise estimate B.

Mathematically, $$V_1=R(0) \tag{9}$$

$$V_2=\min(5{,}059{,}644, \max(KB, B+1)) \tag{10}$$

and the new background noise estimate B is:

$$B=\min(V_1, V_2) \tag{11}$$

where min (x,y) is the minimum of x and y, and max (x,y) is the maximum of x and y.

FIG. 2 further illustrates an exemplary implementation of the background noise estimation algorithm. The first value $V_1$ is simply the current frame energy $E_f$ provided directly to one input of multiplexer 114.

The second value $V_2$ is computed from the values KB and B+1, which are first computed. In computing the values KB and B+1, the previous frame background noise estimate B stored in register 116 is output to adder 118 and multiplier 120. It should be noted that the previous frame background noise estimate B stored in register 116 for use in the current frame is the same as the new background noise estimate B computed in the previous frame. Adder 118 is also provided with an input value of 1 for addition with the value B so as to generate the term B+1. Multiplier 120 is also provided with an input value of K for multiplication with the value B so as to generate the term KB. The terms B+1 and KB are output respectively from adder 118 and multiplier 120 to separate inputs of both multiplexer 122 and adder 124.

Adder 124 and comparator or limiter 126 are used in selecting the larger of the terms B+1 and KB. Adder 124 subtracts the term B+1 from KB and provides the resulting value to comparator or limiter 126. Limiter 126 provides a control signal to multiplexer 122 so as to select an output thereof as the larger of the terms B+1 and KB. The selected term B+1 or KB is output from multiplexer 122 to limiter 128 which is a saturation type limiter which provides either the selected term if below the constant value M, or the value M if above the value M. The output from limiter 128 is provided as the second input to multiplexer 114 and as an input to adder 130.

Adder 130 also receives at another input the frame energy value $E_f$. Adder 130 and comparator or limiter 132 are used in selecting the smaller of the value $E_f$ and the term output from limiter 128. Adder 130 subtracts the frame energy value from the value output from limiter 128 and provides the resulting value to comparator or limiter 132. Limiter 132 provides a control signal to multiplexer 114 for selecting the smaller of the $E_f$ value and the output from limiter 128. The selected value output from multiplexer 114 is provided as the new background noise estimate B to register 116 where stored for use during the next frame as the previous frame background noise estimate B.

As mentioned previously with respect to FIG. 1 the first reflection coefficient $k_0$ computed in the LPC analysis element 12 is used in the full rate override logic as discussed with reference to FIGS. 2, 4 and 5. FIGS. 3 and 4 illustrates in further detail an exemplary implementation of the method by which the reflection coefficients $k_i$ are computed.

Figure 3A:
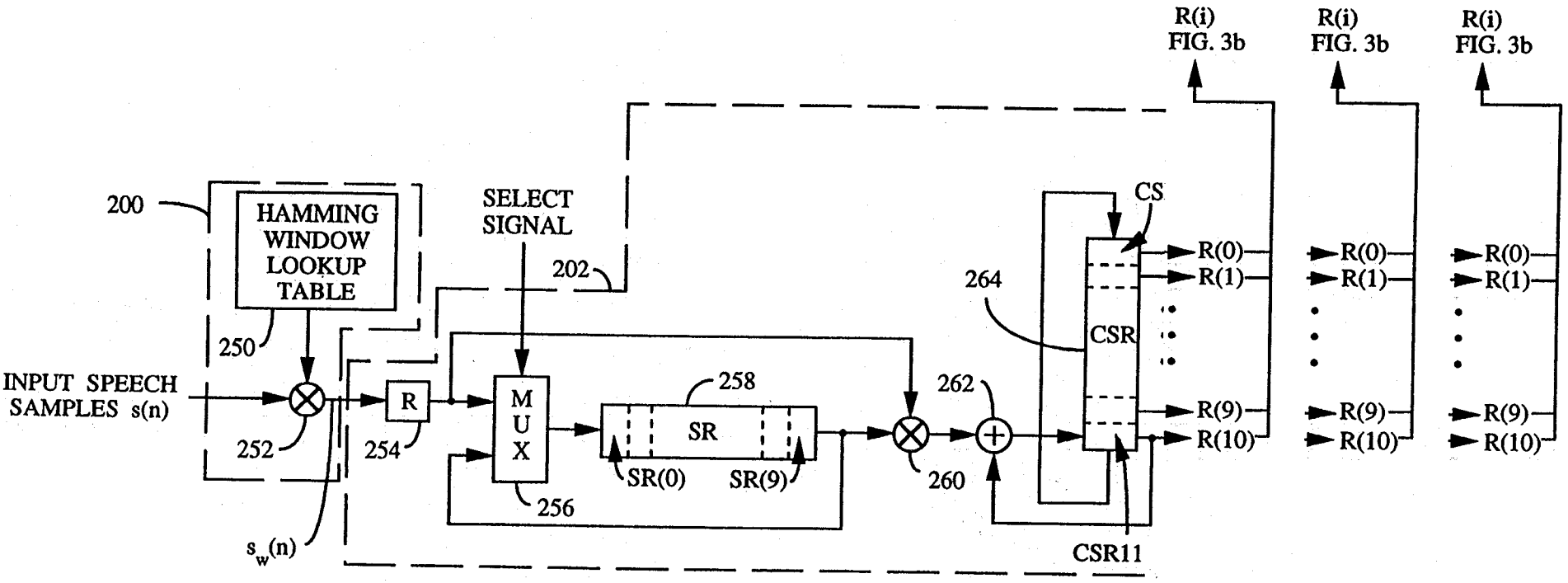
FIGS. 3*a* and 3*b* are block diagrams of the LPC analysis element of FIG. 1.
Figure 3B:
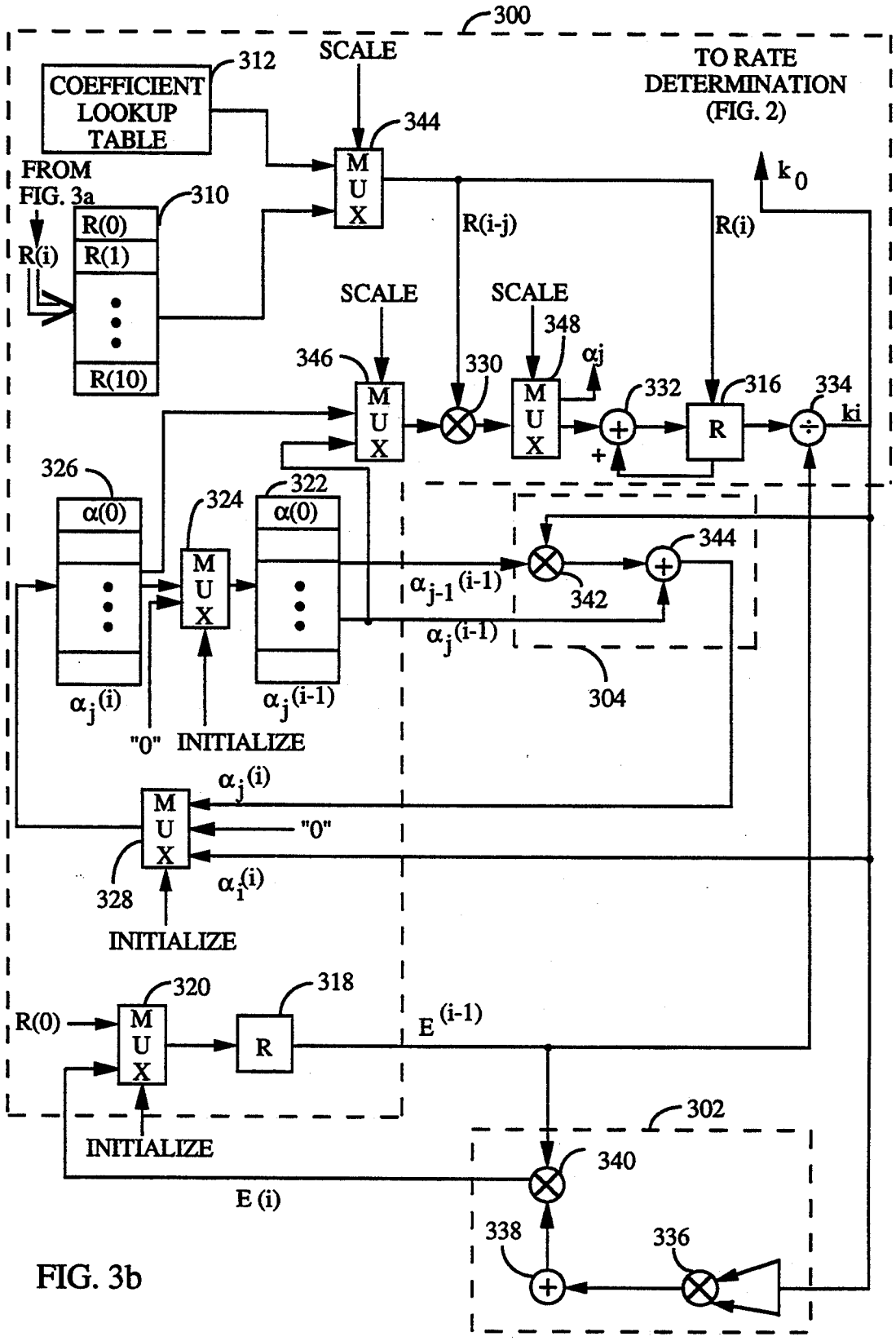
Figure 4:
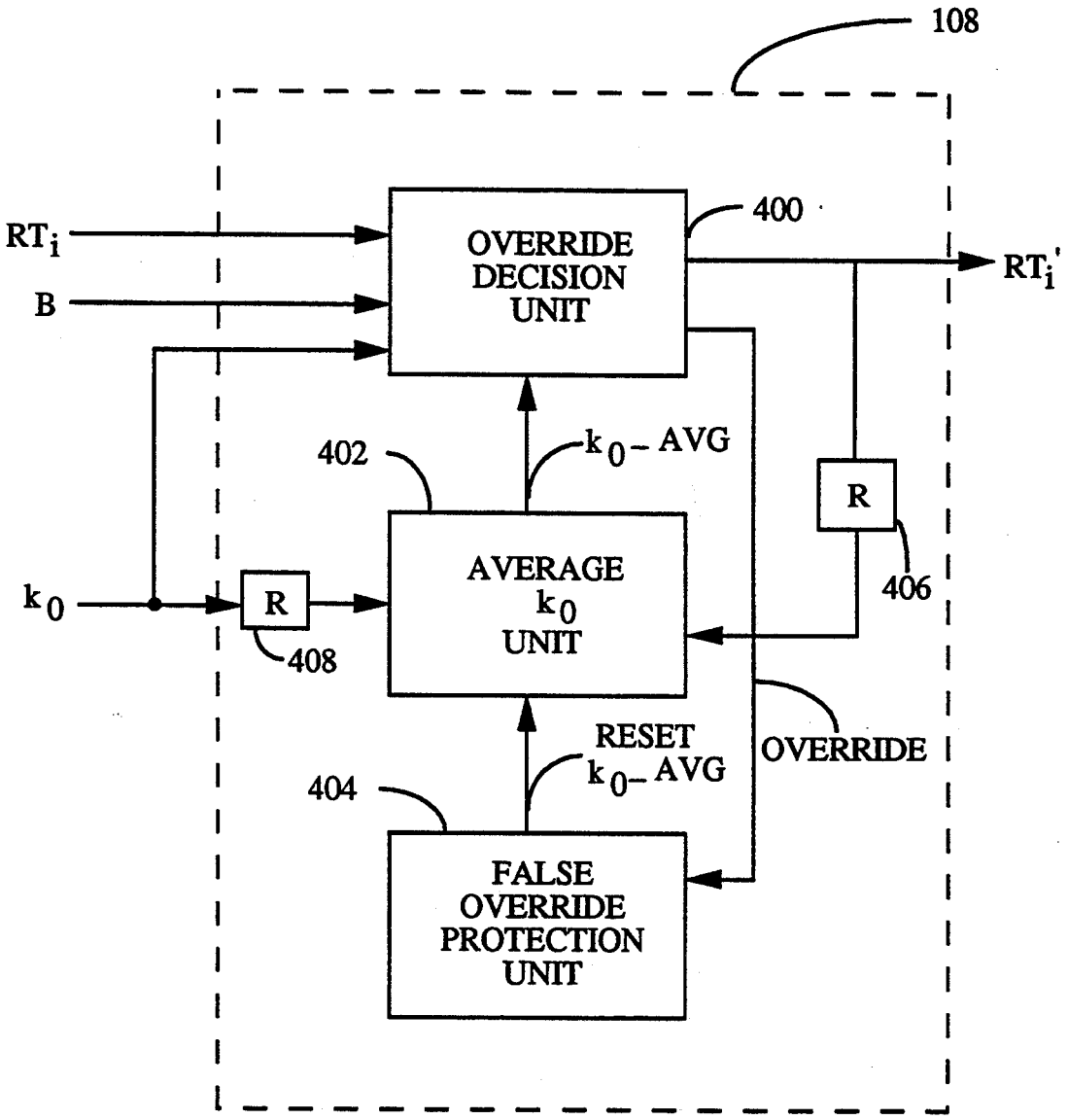
FIG. 4 is a block diagram of the full rate override element in FIG. 2.

In FIGS. 3*a* and 3*b*, LPC analysis is accomplished using the 160 speech data samples of an input frame which are windowed using a Hamming window. For purposes of explanation, the samples, s(n) are numbered 0–159 within each frame. The Hamming window is positioned such that it is offset within the frame by 60 samples. Thus the Hamming window starts at the $60^{th}$ sample, s(59), of the current data frame 10 and continues through and inclusive of the $59^{th}$ sample, s(58), of a following data frame. The weighted data generated for a current frame, therefore also contains data that is based on data from the next frame. It should be understood that the use of a Hamming window is not absolutely necessary and that it need not be used or other Hamming windows may be used. In the exemplary embodiment once the samples have been weighted by the Hamming window process $10^{th}$ order autocorrelation coefficients for the frame are computed.

In FIG. 3*a* an exemplary implementation of a Hamming window subsystem 200 and autocorrelation subsystem 202 are illustrated. Hamming window subsystem 200 which is comprised of lookup table 250, typically an a 80×16 bit Read Only Memory (ROM), and multiplier 252. The window of speech is centered between the 139th and the 140th sample of each frame which is 160 samples long. The window for computing the autocorrelation coefficients is thus offset from the frame by 60 samples.

Windowing is done using a ROM table containing 80 of the 160 $W_H(n)$ values, since the Hamming window is symmetric around the center. The offset of the Hamming window is accomplished by skewing the address pointer of the ROM by 60 positions with respect to the first sample of an analysis frame. These values are multiplied in single precision with the corresponding input speech samples by multiplier 252. Let s(n) be the input speech signal in the analysis window. The windowed speech signal $s_w(n)$ is thus defined by:

$$s_w(n)=s(n+60)W_H(n) \text{ for } 0<=n<=79 \quad (12)$$

and $$s_w(n)=s(n+60)W_H(159-n) \text{ for } 80<=n21=159. \quad (13)$$

Exemplary values, in hexadecimal, of the contents of lookup table 250 are set forth in Table I. These values are interpreted as two's complement numbers having 14 fractional bits with the table being read in the order of left to right, top to bottom.

TABLE I

| | | | | | | | |
|---|---|---|---|---|---|---|---|
| 0 × 051f | 0 × 0525 | 0 × 0536 | 0 × 0554 | 0 × 057d | 0 × 05b1 | 0 × 05f2 | 0 × 063d |
| 0 × 0694 | 0 × 06f6 | 0 × 0764 | 0 × 07dc | 0 × 085e | 0 × 08ec | 0 × 0983 | 0 × 0a24 |
| 0 × 0ad0 | 0 × 0b84 | 0 × 0c42 | 0 × 0d09 | 0 × 0dd9 | 0 × 0eb0 | 0 × 0f90 | 0 × 1077 |
| 0 × 1166 | 0 × 125b | 0 × 1357 | 0 × 1459 | 0 × 1560 | 0 × 166d | 0 × 177f | 0 × 1895 |
| 0 × 19af | 0 × 1acd | 0 × 1bee | 0 × 1d11 | 0 × 1e37 | 0 × 1f5e | 0 × 2087 | 0 × 21b0 |
| 0 × 22da | 0 × 2403 | 0 × 252d | 0 × 2655 | 0 × 277b | 0 × 28a0 | 0 × 29c2 | 0 × 2ae1 |
| 0 × 2bfd | 0 × 2d15 | 0 × 2e29 | 0 × 2f39 | 0 × 3043 | 0 × 3148 | 0 × 3247 | 0 × 333f |
| 0 × 3431 | 0 × 351c | 0 × 3600 | 0 × 36db | 0 × 37af | 0 × 387a | 0 × 393d | 0 × 39f6 |
| 0 × 3aa6 | 0 × 3b4c | 0 × 3be9 | 0 × 3c7b | 0 × 3d03 | 0 × 3d80 | 0 × 3df3 | 0 × 3e5b |
| 0 × 3eb7 | 0 × 3f09 | 0 × 3f4f | 0 × 3f89 | 0 × 3fb8 | 0 × 3fdb | 0 × 3ff3 | 0 × 3fff |

Autocorrelation subsystem 202 computes a set of ten autocorrelation coefficients according to the following equation:

$$E_f = \sum_{n=0}^{L_A-1-k} s_w(n)s_w(n+k); \quad (14)$$

for $k = 0, 2, \ldots, 9$ where $s_w(n)$ is the frame weighted speech sample; and $L_A$ is the frame size.

Autocorrelation subsystem 202 is comprised of register 254, multiplexer 256, shift register 258, multiplier 260, adder 262, circular shift register 264 and buffer 266. The windowed speech samples $s_w(n)$ are computed every 20 msec. and latched into register 254. On sample $s_w(0)$, the first sample of an LPC analysis frame, shift registers 258 and 264 are reset to 0. On each new sample $s_w(n)$, multiplexer 256 receives a new sample select signal which allows the sample to enter from register 254. The new sample $s_w(n)$ is also provided to multiplier 260 where multiplied by the sample $s_w(n-10)$, which is in the last position SR10 of shift register 258. The resultant value is added in adder 262 with the value in the last position CSR11 of circular shift register 264.

Shift registers 258 and 260 clocked once, replacing $s_w(n-1)$ by $s_w(n)$ in the first position SR1 of shift register 258 and replacing the value previously in position CSR10. Upon clocking of shift 258 the new sample select signal is removed from input to multiplexer 256 such that the sample $s_w(n-9)$ currently in the position SR10 of shift register 260 is allowed to enter multiplexer 256. In circular shift register 264 the value previously in position CSR11 is shifted into the first position CSR1. With the new sample select signal removed from multiplexer, shift register 258 set to provide a circular shift of the data in the shift register like that of circular shift register 264.

Shift registers 258 and 264 are both clocked 11 times in all for every sample such that 11 multiply/accumulate operations are performed. After 160 samples have been clocked in, the autocorrelation results, which are contained in circular shift register 264, are clocked into buffer 266 as the values R(0)–R(10). All shift registers are reset to zero, and the process repeats for the next frame of windowed speech samples.

In FIG. 3b, once the ten autocorrelation coefficients R(0)–R(10) have been computed for the speech frame LPC analysis subsystem 206 uses this data to respectively compute the LPC coefficients. In computing the LPC coefficients, reflection coefficients $k_i$ are produced. The reflection coefficients $k_0$ is provided to rate determination element 18 as discussed with reference to FIGS. 1 and 2.

The LPC coefficients may be obtained by an autocorrelation method using Durbin's recursion as discussed in *Digital Processing of Speech Signals*, Rabiner & Schafer, Prentice-Hall, Inc., 1978. This technique is an efficient computational method for obtaining the LPC coefficients. The algorithm can be stated in the following equations:

$$E^{(0)} = R(0),\ i = 1; \tag{15}$$

$$k_i = \left\{ R(i) - \sum_{j=1}^{i-1} \alpha_j^{(i-1)} R(i-j) \right\} / E^{(i-1)}; \tag{16}$$

$$\alpha_i^{(i)} = k_i; \tag{17}$$

$$\alpha_j^{(i)} = \alpha_j^{(i-1)} - k_i \alpha_{i-j}^{(i-1)} \tag{18}$$

for $1 <= j <= i-1$;

$$E^{(i)} = (1 - k_i^2) E^{(i-1)}; \text{ and} \tag{19}$$

If $i < 10$ then goto equation (16) with $i = i + 1$. (20)

The ten LPC coefficients are labeled $\alpha_j^{(10)}$, for $1<=j<=10$

Prior to encoding of the LPC coefficients, the stability of the filter must be ensured. Stability of the filter is achieved by radially scaling the poles of the filter inward by a slight amount which decreases the magnitude of the peak frequency responses while expanding the bandwidth of the peaks. This technique is commonly known as bandwidth expansion, and is further described in the article "Spectral Smoothing in PARCOR Speech Analysis-Synthesis" by Tohkura et. al., *ASSP Transactions*, December 1978. In the present case bandwidth expansion can be efficiently done by scaling each LPC coefficient. Therefore, as set forth below in Table II, the resultant LPC coefficients are each multiplied by a corresponding hex value to yield the final output LPC coefficients $\alpha_1$–$\alpha_{10}$ of LPC analysis subsystem 206. It should be noted that the values presented in Table II are given in hexadecimal with 15 fractional bits in two's complement notation. In this form the value 0×8000 represents −1.0 and the value 0×7333 (or 29491) represents 0.899994=29,491/32,768.

TABLE II

| | |
|---|---|
| $\alpha_1 = \alpha_1^{(10)}$ | 0 × 7333 |
| $\alpha_2 = \alpha_2^{(10)}$ | 0 × 67ae |
| $\alpha_3 = \alpha_3^{(10)}$ | 0 × 5d4f |
| $\alpha_4 = \alpha_4^{(10)}$ | 0 × 53fb |
| $\alpha_5 = \alpha_5^{(10)}$ | 0 × 4b95 |
| $\alpha_6 = \alpha_6^{(10)}$ | 0 × 4406 |
| $\alpha_7 = \alpha_7^{(10)}$ | 0 × 3d38 |
| $\alpha_8 = \alpha_8^{(10)}$ | 0 × 3719 |
| $\alpha_9 = \alpha_9^{(10)}$ | 0 × 3196 |
| $\alpha_{10} = \alpha_{10}^{(10)}$ | 0 × 2ca1 |

The operations are preferably performed in double precision, i.e. 32 bit divides, multiplies and additions. Double precision accuracy is preferred in order to maintain the dynamic range of the autocorrelation functions and filter coefficients.

In FIG. 10, a block diagram of an exemplary embodiment of the LPC subsystem 206 is shown which implements equations (15)–(20) above. LPC subsystem 206 is comprised of three circuit portions, a main computation circuit 300 and two buffer update circuits 302 and 304 which are used to update the registers of the main computation circuit 300. Computation is begun by first loading the values R(1)–R(10) into buffer 310. To start the calculation, register 318 is preloaded with the value R(1) via multiplexer 314. Register is initialized with R(0) via multiplexer 320, buffer 322 (which holds 10 $\alpha_j^{(i-1)}$ values) is initialized to all zeroes via multiplexer 324, buffer 326 (which holds 10 $\alpha_j^{(i)}$ values) is initialized to all zeroes via multiplexer 328, and i is set to 1 for the computational cycle. For purposes of clarity counters for i and j and other computational cycle control are not shown but the design and integration of this type of logic circuitry is well within the ability of one skilled in the art in digital logic design.

The $\alpha_j^{(i-1)}$ value is output from buffer 326 to compute the term $k_i E^{(i-1)}$ as set forth in equation (16). Each value R(i−j) is output from buffer 310 for multiplication with the $\alpha_j^{(i-1)}$ value in multiplier 330. Each resultant value is subtracted in adder 332 from the value in register 316. The result of each subtraction is stored in register 316 from which the next term is subtracted. There are i−1 multiplications and accumulations in $i^{th}$ cycle, as indicated in the summation term of equation (16). At the end of this cycle, the value in register 316 is divided in divider 334 by the value $E^{(i-1)}$ from register 318 to yield the value $k_i$.

The value $k_i$ is then used in buffer update circuit 302 to calculate the value $E^{(i)}$ as in equation (19) above, which is used as the value $E^{(i-1)}$ during the next computational cycle of $k_i$. The current cycle value $k_i$ is multiplied by itself in multiplier 336 to obtain the value $k_i^2$. The value $k_i^2$ is then subtracted from the value of 1 in adder 338. The result of this addition is multiplied in multiplier 340 with the value $E^{(i)}$ from register 318. The resulting value $E^{(i)}$ is input to register 318 via multiplexer 320 for storage as the value $E^{(i-1)}$ for the next cycle.

The value $k_i$ is then used to calculate the value $\alpha_i^{(i)}$ as in equation (17). In this case the value $k_i$ is input to buffer 326 via multiplexer 328. The value $k_i$ is also used in buffer update circuit 304 to calculate the values $\alpha_j^{(i)}$ from the values $\alpha_j^{(i-1)}$ as in equation (18). The values currently stored in buffer 352 are used in computing the values $\alpha_j^{(i)}$. As indicated in equation (18), there are i−1 calculations in the $i^{th}$ cycle. In the i=1 iteration no such calculations are required for each value of j for the $i^{th}$ cycle a value of $\alpha_j^{(i)}$ is computed. In computing each value of $\alpha_j^{(i)}$, each value of $\alpha_{i-j}^{(i-1)}$ is multiplied in multiplier 342 with the value $k_i$ for output to adder 344. In adder 344 the value $k_i \alpha_{i-j}^{(i-1)}$ is subtracted from the value $\alpha_j^{(i-1)}$ also input to adder 344. The result of each multiplication and addition is provided as the value of $\alpha_j^{(i)}$ to buffer 326 via multiplexer 328.

Once the values $\alpha_i^{(i)}$ and $\alpha_j^{(i)}$ are computed for the current cycle, the values just computed and stored in buffer 326 are output to buffer 322 via multiplexer 324. The values stored in buffer 326 are stored in corresponding positions in buffer 322. Buffer 322 is thus updated for computing the value $k_i$ for the i+1 cycle.

It is important to note that data $\alpha_j^{(i-1)}$ generated at the end of a previous cycle is used during the current cycle to generate updates $\alpha_j^{(i)}$ for a next cycle. This previous cycle data must be retained in order to completely generate updated data for the next cycle. Thus two buffers 326 and 322 are utilized to preserve this previous cycle data until the updated data is completely generated.

The above description is written with respect to a parallel transfer of data from buffer 326 to buffer 322 upon completion of the calculation of the updated values. This implementation ensures that the old data is retained during the entire process of computing the new data, without loss of the old data before completely used as would occur in a single buffer arrangement. The described implementation is one of several implementations that are readily available for achieving the same result. For example, buffers 322 and 326 may be multiplexed such that upon calculating the value $k_i$ for a current cycle from values stored in a first buffer, the updates are stored in the second buffer for use during the next computational cycle. In this next cycle the value $k_i$ is computed from the values stored in the second buffer. The values in the second buffer and the value $k_i$ are used to generate updates for the next cycle with these updates stored in the first buffer. This alternating of buffers enables the retention of proceeding computational cycle values, from which updates are generated, while storing update values without overwriting the proceeding values which are needed to generate the updates. Usage of this technique can minimize the delay associated with the computation of the value $k_i$ for the next cycle. Therefore the updates for the multiplications/accumulations in computing $k_i$ may be done at the same time as the next value of $\alpha_j^{(i-1)}$ is computed.

The ten LPC coefficients $\alpha_j^{(10)}$, stored in buffer 326 upon completion of the last computational cycle (i=10), are scaled to arrive at the corresponding final LPC coefficients $\alpha_j$. Scaling is accomplished by providing a scale select signal to multiplexers 314, 346 and 348 so that the scaling values stored in lookup table 312, hex values of Table II, are selected for output through multiplexer 314. The values stored in lookup table 312 are clocked out in sequence and input to multiplier 330. Multiplier 330 also receives via multiplexer 346 the $\alpha_j^{(10)}$ values sequentially output from register 326. The scaled values are output from multiplier 330 via multiplexer 348 as an output to residual quantization element 14 (FIG. 1).

As mentioned previously with reference to FIG. 2, the reflection coefficient $k_0$ as computed with reference to FIG. 3b is provided to full rate override logic 108. Also input to full rate override logic 108 is the background noise estimate B for the current frame. These values are used to determine when the intermediate rate value $RT_i$ is less than full rate if it should be modified to the full rate indication. FIG. 4 illustrates in block diagram form an exemplary structure of full rate override logic 108 while FIG. 5 is a flow diagram of the function of algorithm employed by full rate override logic 108.

In FIG. 4 full rate override logic 108 is comprised of three major functional elements, override decision unit 400, average $k_0$ unit 402 and false override protection unit 404. In an exemplary implementation full rate override logic 108 along with the other elements of the vocoder may be implemented in a conventional digital signal processor using the teachings as disclosed herein. In the alternative, the vocoder may be implemented in a custom application specific integrated circuit form.

As illustrated in FIGS. 2 and 4, full rate override logic 108 receives inputs of the intermediate rate decision $RT_i$, the background noise estimate B, and the first reflection coefficient $k_0$. Within full rate override logic 108, override decision unit 400 makes a rate override decision based upon the values of the intermediate rate decision $RT_i$, the background noise estimate B, the first reflection coefficient $k_0$ and an average of the first reflection coefficient $k_0$ of eighth rate frames. The rate value, whether modified or not by override decision unit 400, is provided as the intermediate rate decision $RT_i'$. Further operation of the full rate override logic 108 is described with reference to the flow chart of FIG. 5.

Average $k_0$ unit 402 receives the intermediate rate decision $RT_i'$ and first reflection coefficient $k_0$ respectively through registers 406 and 408. Average $k_0$ unit 402 computes an average of first reflection coefficient $k_0$ ($k_0$_AVG) for eighth rate frames as indicated by the intermediate rate decision $RT_i'$. One frame of delay is provided in the averaging process to ensure that an overriden frame rate is not used in the average computation. An exemplary averaging scheme is illustrated by the following equation:

$$k_0_AVG(n)=0.9\,(k_0_AVG(n-1))+0.1\,(k_0(n)) \qquad (21).$$

False override protection unit 404 is provided to limit the number of overrides that may occur within a certain time duration. As stated earlier the override is used to encode unvoiced speech at a higher rate than background noise. Since unvoiced speech is typically of a limited time duration, typically no more than a second or 50 frames, the override need only last sufficient time to ensure encoding of the unvoiced speech at the higher rate. however on occasion unvoiced speech may be of a longer duration such as sounds of emphasis at the beginning of certain words. Although false override protection unit 404 may attempt to encode at a lower rate after about a 50 frame duration typically such sounds of emphasis contain a higher level of frame energy that would indicate that the frame is to be encoded at the higher rate.

False override protection unit 404 receives an indication from override decision for each frame in which the determined rate is override. Upon determining that a maximum number of overrides has occurred, false override protection unit 404 provides an reset indication to average $k_0$ unit 402 which resets the value of $k_0$_AVG to a value of zero. The setting of the value of $k_0$_AVG to zero effectively disables the override decision unit from overriding a rate decision for the next frame. Further details on this action will be discussed with reference to FIG. 5 later herein.

False override protection unit 404 may be implemented simply as a counter which is counts each frame override and upon reaching a maximum count value resets itself and provides the reset indication to average $k_0$ unit 402. In a more sophisticated implementation, false override protection unit 404 may be configured to produce a reset indication according to the following algorithm:

$$\text{OVERRIDE}(n)=0.95\,(\text{OVERRIDE}(n-1))+x(n) \quad (22)$$

where:

x(n)=128 if override is true (a frame rate decision override occurred); and 0 if override is false (a frame rate decision override did not occur), and where:

$$\text{if OVERRIDE}(n)>2304 \text{ set } k_0_\text{AVG}(n)=0. \quad (23)$$

Figure 5:
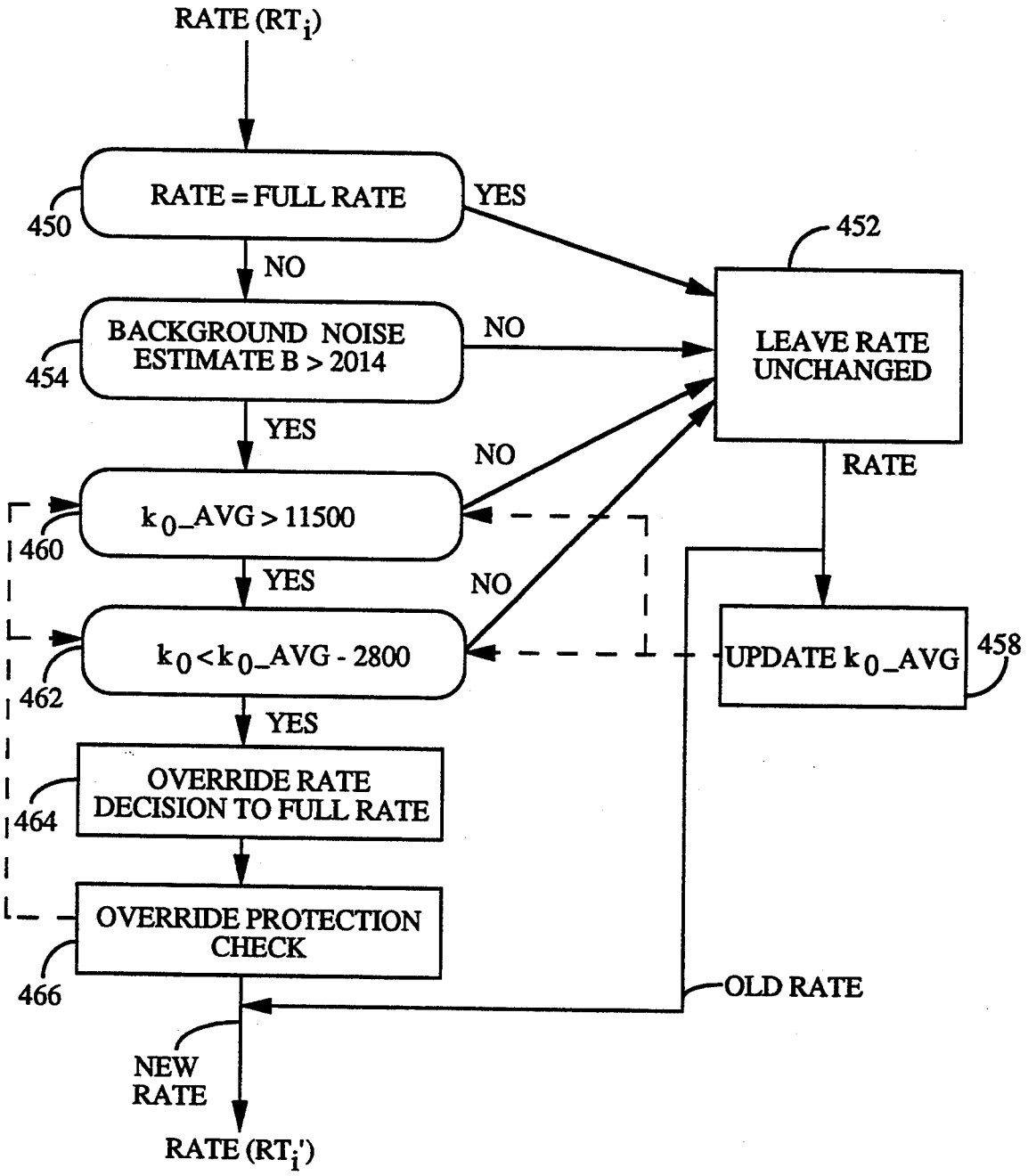
FIG. 5 is a flow diagram of the full rate override rate decision algorithm as implemented in the full rate override element of FIG. 2.

In FIG. 5 a flow diagram of the operation of full rate override logic 108 is provided. In a preferred implementation of the present invention, the full rate override algorithm is implemented only if the rate is full and the background noise is greater than a predetermined value, such as 11 dB (a value of 2014). The background noise constraint is imposed upon the algorithm, because under quiet background noise conditions the unvoiced sections of speech are easily identifiable by the energy based rate decision algorithm. Thus there is no advantage to enable the full rate override algorithm and possibly risk a false override decision.

In full rate override logic 108 a determination is made as to whether the rate decision based upon the frame energy is a full rate decision, block 450. If the rate decision is full rate then the rate decision is unchanged, block 452, and provided as an output (OLD RATE) to hangover logic 110 if provided, or rate limiter logic 112 of FIG. 2.

Should the rate be determined to be less than full rate in block 450, a determination is made in block 454 as to whether the background noise B exceeds the 2014 value. If the background noise does not exceed this value the rate is unchanged, block 452, and output as the OLD RATE as discussed above.

Each time a determination is made in block 452 to leave the rate unchanged an additional operation is performed. A determination is made as to whether the rate for the frame is eighth rate, block 458, and if so the average of an average of first reflection coefficients $k_0$ for eighth rate frames ($k_0$_AVG) is computed/updated according to equation (21).

If in block 454 the background noise is determined to exceed this value a determination is made in block 460 as to whether the average of first reflection coefficients $k_0$ for eighth rate frames ($k_0$_AVG) is greater than a predetermined value. If the first reflection coefficient $k_0$ average does not exceed this value it is an indication that the spectral tilt characteristic of the background noise is not of road and office noise, and thus the full rate override algorithm can not be safely used to detect unvoiced speech. Again the reason for this comparison is to reduce the possibility of false override detections from occurring. It should be noted for reference purposes that the first reflection coefficient $k_0$ may in a DSP implementation (using fixed point code) take on a value between ±1.0 (which may be represented as a value between $\pm 2^{14}$). With this parameter in mind in block 460 a determination is made as to whether the value $k_0$_AVG exceeds a value of 11,500. If not the determined rate is unchanged, block 452, and output as discussed above.

However if the value $k_0$_AVG exceeds a value of )) + 11,500 a determination is made as to whether a full rate override decision is made, block 462. In block 462 the first reflection coefficient $k_0$ of the current frame is compared to the value $k_0$_AVG. If the first reflection coefficient $k_0$ is less than the value $k_0$_AVG minus 2800 then the input frame is determined to be a broadband signal and not background noise. In this case the rate decision is modified to a full rate value and provided as NEW RATE, block 462. However should the frame be determined to be background noise, $k_0$ is greater than $k_0$_AVG minus 2800, the rate is unchanged, block 452, and output as discussed above.

As an added feature mentioned above, a false override protection check is made upon the determination of a NEW RATE in block 464. Accordingly an indication, which may be the fact that a NEW RATE value was produced, the NEW RATE itself or other similar indication is provided from block 464 for a false override protection check, block 466. Although the false override protection check does not affect the current rate override decision NEW RATE, the value of $k_0$_AVG is set to zero for use in blocks 460 and 462 for rate override decisions in following frames will effectively be disabled. Further details on an exemplary implementation of the false override protection check of block 466 is discussed above with reference to equations (22) through (23).

The present invention provides a novel and improved technique for, in a variable rate vocoder, enhancing the quality of vocoded speech. In encoding unvoiced speech at higher rates in backgrounds of road and office noise the overall performance of the vocoding and communication system is improved. It should be understood that a basic premise of the present invention is the utilization of the spectral tilt of the signal to determine unvoiced speech from high background road and office noise to supplement rate determination based upon an energy parameter alone. As such, the present invention is applicable to all variable rate vocoders and not limited to those which use LPC coding techniques. The use of the first reflection coefficient is but one technique for evaluating the spectral tilt of the signal and other techniques can be considered equivalents thereto. Other equivalent spectral evaluation techniques may include for example DFT or other order LPC models. Other techniques for measuring spectral tilt would include zero crossing measurement, where many zero crossings correspond to higher frequencies and thus indicate broadband signal energy, or a comparison of high frequency band energy to low frequency band energy. It should be understood that many of the exemplary values and parameters utilized in the present invention may be modified without affecting the scope of the teachings of the present invention.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

I claim:

1. In a variable rate vocoder a method for determining a higher encoding rate of a set of encoding rates for unvoiced speech comprising the steps of:
   generating a variable rate encoding rate indication based upon a first characteristic of an audio signal;
   determining a second characteristic of said audio signal;
   comparing said second characteristic against an unvoiced speech threshold;
   determining from said comparison if said audio signal is representative of unvoiced speech; and
   modifying said variable rate encoding rate indication when said second characteristic of said audio signal is representative of unvoiced speech to provide a modified encoding rate indication corresponding to a higher encoding rate of said set of encoding rates.

2. The method of claim 1 wherein said first characteristic is signal energy and said second characteristic is spectral tilt.

3. In a variable rate vocoder a method for determining a higher encoding rate of a set of encoding rates for unvoiced speech comprising the steps of:
   generating an encoding rate indication based upon a level of signal energy in samples of an audio signal;
   determining a spectral characteristic of said samples;
   comparing said spectral characteristic of said samples with respect to a spectral characteristic of audio noise;
   modifying said encoding rate indication when said comparison result indicates that said spectral characteristic of said samples is different from said spectral characteristic of audio noise to provide a modified encoding rate indication corresponding to a higher encoding rate of said set of encoding rates.

4. The method of claim 3 further comprising the steps of:
   determining a level of audio noise from previous samples of said audio signal; and
   disabling said modification of said encoding rate indication when said level of audio noise is less than a predetermined level.

5. The method of claim 3 further comprising the steps of:
   detecting occurrences of modified encoding rate indications; and
   disabling said modification of said encoding rate indication when occurrences of said modified encoding rate indications exceed a predetermined level.

6. In a variable rate vocoder wherein the number of bits used to encode a frame of speech data, a method for determining an encoding rate for said frame of speech data comprising the steps of:
   determining a frame energy;
   selecting an encoding rate from a predetermined set of coding rates in accordance with said frame energy;
   determining a spectral tilt value for said frame;
   comparing said spectral tilt value with an unvoiced speech threshold;
   providing an unvoiced speech signal when said spectral tilt value exceeds said unvoiced speech threshold; and
   modifying said encoding rate in accordance with said unvoiced speech signal.

7. The method of claim 6 wherein the step of selecting an encoding rate comprises the steps of:
   comparing said frame energy against a predetermined set of energy thresholds; and
   selecting an encoding rate from said comparison.

8. The method of claim 7 wherein the values of said energy thresholds varies in accordance with the speech energy level of present and previous speech frames.

9. In a variable rate code excited linear prediction (CELP) coder for encoding a frame of speech data wherein the number of bits to encode said frame of speech data varies, a method for encoding said frame of speech data comprising the steps of:
   removing short-term redundancies from said frame of speech data by means of a formant filter to provide a pitch residual signal;
   removing long-term redundancies from said pitch residual signal by means of a pitch filter to provide a residual signal;
   determining an energy level for said frame of speech data;
   selecting an encoding rate for said frame of speech data in accordance with said energy level;
   determining a spectral tilt value of said frame of speech data;
   modifying said encoding rate when said spectral tilt value exceeds a predetermined threshold;
   allocating a number of bits for parameters of said formant filter, a number of bits for parameters of said pitch filter and a number of bits for said residual signal in accordance with said encoding rate; and
   encoding said parameters of said formant filter, said parameters of said pitch filter and said residual signal in accordance with said allocated number of bits.

10. The method of claim 9 wherein the step of selecting an encoding rate comprises the steps of:
   comparing said frame energy against a predetermined set of energy thresholds; and
   selecting an encoding rate from said comparison.

11. In a variable rate vocoder, a method for distinguishing unvoiced speech signals from background noise comprising the steps of:

receiving an audio signal;

determining a spectral tilt value for said audio signal;

comparing said spectral tilt signal against an unvoiced speech threshold; and providing an unvoiced speech signal when said spectral tilt exceeds said unvoiced speech threshold.

12. The method of claim 11 further comprising the steps of:

determining an energy value for said audio signal;

inhibiting the provision of said unvoiced speech signal when said energy value exceeds a predetermined threshold.

* * * * *